US010763012B2

(12) United States Patent
Watanabe et al.

(10) Patent No.: US 10,763,012 B2
(45) Date of Patent: Sep. 1, 2020

(54) SHIELDED CABLE

(71) Applicant: Hitachi Metals, Ltd., Tokyo (JP)

(72) Inventors: Haruyuki Watanabe, Tokyo (JP); Detian Huang, Tokyo (JP); Kazuhiro Aida, Tokyo (JP); Masanori Kobayashi, Tokyo (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 16/039,145

(22) Filed: Jul. 18, 2018

(65) Prior Publication Data

US 2019/0304633 A1 Oct. 3, 2019

(30) Foreign Application Priority Data

Mar. 29, 2018 (JP) ..... 2018-064881

(51) Int. Cl.

| | |
|---|---|
| ***H01B 11/18*** | (2006.01) |
| ***H01B 11/10*** | (2006.01) |
| ***H01B 7/17*** | (2006.01) |
| ***H01B 11/20*** | (2006.01) |
| ***H01B 1/02*** | (2006.01) |

(52) U.S. Cl.

CPC ..... *H01B 11/1033* (2013.01); *H01B 1/026* (2013.01); *H01B 7/17* (2013.01); *H01B 11/1808* (2013.01); *H01B 11/20* (2013.01)

(58) Field of Classification Search

CPC ... H01B 7/02; H01B 7/04; H01B 7/11; H01B 11/026; H01B 11/1033; H01B 11/1808; H01B 11/20

USPC ..... 174/32, 33, 36, 102 R, 103, 105 R, 106, 174/107, 108

See application file for complete search history.

(56) References Cited

U.S. PATENT DOCUMENTS 2,028,793 A * 1/1936 Mascuch ..... H01B 7/0063 123/633
2,141,290 A * 12/1938 Carlson ..... H01B 7/226 174/106 R
3,355,544 A * 11/1967 Costley ..... H01B 7/228 174/106 R (Continued)

FOREIGN PATENT DOCUMENTS

JP H02-021511 A 1/1990
JP H04-072507 A 3/1992

(Continued)

OTHER PUBLICATIONS

Japanese Office Action dated Jul. 3, 2018 in corresponding Japanese Application No. 2018-064881, with an English translation thereof.

*Primary Examiner* — William H. Mayo, III
(74) *Attorney, Agent, or Firm* — McGinn IP Law Group, PLLC

(57) ABSTRACT

A shielded cable includes an inner conductor, an insulation covering an outer periphery of the inner conductor, and an outer conductor covering an outer periphery of the insulation. The outer conductor includes a first outer conductor covering the outer periphery of the insulation and including a served shield with first element wires spirally wound, and a second outer conductor covering an outer periphery of the first outer conductor and including a braided shield with second element wires braided.

23 Claims, 1 Drawing Sheet

(56) References Cited

U.S. PATENT DOCUMENTS

| | | | | | |
|---|---|---|---|---|---|
| 4,552,989 | A * | 11/1985 | Sass | H01B 11/20 | 174/103 |
| 4,626,810 | A * | 12/1986 | Nixon | H01B 11/1821 | 156/244.11 |
| 5,012,045 | A * | 4/1991 | Sato | H01B 11/1033 | 174/106 R |
| 5,061,823 | A * | 10/1991 | Carroll | H01B 7/22 | 174/105 R |
| 5,304,739 | A * | 4/1994 | Klug | H01B 3/443 | 174/102 R |
| 5,391,836 | A * | 2/1995 | Bortas | H01B 9/02 | 174/103 |
| 5,463,188 | A * | 10/1995 | Nohmi | H01B 11/1821 | 174/102 R |
| 5,477,011 | A * | 12/1995 | Singles | H01B 11/1066 | 174/102 R |
| 6,417,445 | B1 * | 7/2002 | Sato | H01B 11/1808 | 174/28 |
| 8,530,745 | B2 * | 9/2013 | Eshima | H01B 13/141 | 174/108 |
| 2006/0254801 | A1 * | 11/2006 | Stevens | H01B 11/1008 | 174/102 R |
| 2011/0061887 | A1 * | 3/2011 | Amato | H01B 7/2806 | 174/102 R |

FOREIGN PATENT DOCUMENTS

| | | | | |
|---|---|---|---|---|
| JP | 2010-027491 A * | 2/2010 | H01B 11/18 | |
| JP | 2011-222201 A * | 11/2011 | H01B 11/18 | |

* cited by examiner

SHIELDED CABLE

The present application is based on Japanese patent application No. 2018-064881 filed on Mar. 29, 2018, the entire contents of which are incorporated herein by reference.

BACKGROUND OF THE INVENTION

1. Field of the Invention

This invention relates to a shielded cable.

2. Description of the Related Art

A shielded cable (also referred to as a coaxial cable) is known which is provided with an insulation, an outer conductor and a jacket installed sequentially on the outer periphery of an inner conductor.

It is known that if a shielded cable o transmit signals at high speed of not less than 3 GHz uses a shielding structure with a shielding tape spirally wound, the shielding tape having a metal layer formed on one side surface of a resin layer, it may cause a phenomenon, which is called "suck out", where a large attenuation occurs at a specific frequency and, eventually, its attenuation property at high frequency degrades. Thus, for the shielded cable transmitting signals at high speed of not less than 3 GHz, a shielding structure is generally used that the shielding tape is longitudinally wrapped on the outer periphery of the insulation so as to prevent the degradation of the attenuation property at high frequency (see e.g., JP H04/72507 A).

SUMMARY OF THE INVENTION

Along with the expanded application of camera sensors, high-speed transmission shielded cables have been used even at a moving part that is bent repeatedly. Thus, high flex resistance is needed for the high-speed transmission shielded cables.

The shielding structure with the shielding tape longitudinally wrapped can have good attenuation property at high frequency. However, a problem may arise that the shielding tape is wrinkled and cracked by being bent repeatedly. Thus, the flex resistance is not enough.

It is an object of the invention to provide a high-speed transmission shielded cable that is excellent in the flex resistance while having good attenuation property at high frequency.

According to an embodiment of the invention, a shielded cable comprises:

an inner conductor, an insulation covering an outer periphery of the inner conductor; and an outer conductor covering an outer periphery of the insulation, wherein the outer conductor comprises a first outer conductor covering the outer periphery of the insulation and comprising a served shield with first element wires spirally wound, and a second outer conductor covering an outer periphery of the first outer conductor and comprising a braided shield with second element wires braided.

Effects of the Invention

According to an embodiment of the invention, a high-speed transmission shielded cable can be provided that is excellent in the flex resistance while having good attenuation property at high frequency.

BRIEF DESCRIPTION OF THE DRAWINGS

Next, the present invention will be explained in conjunction with appended drawings, wherein.

DETAILED DESCRIPTION OF THE PREFERRED EMBODIMENTS

Embodiment

Next, an embodiment according to the invention will be described with the accompanying drawings.

(Overall Structure of Shielded Cable)

Figure 1A:
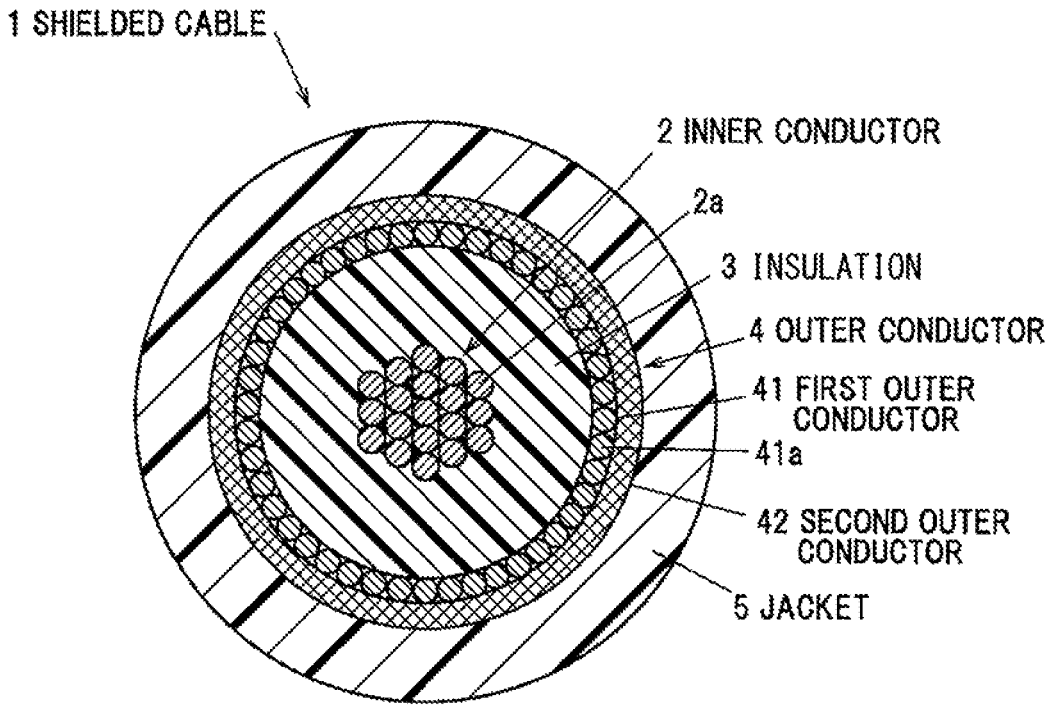
FIG. 1A is a cross sectional view showing a shielded cable in an embodiment of the invention along a cross section orthogonal to a longitudinal direction of the cable.
Figure 1B:
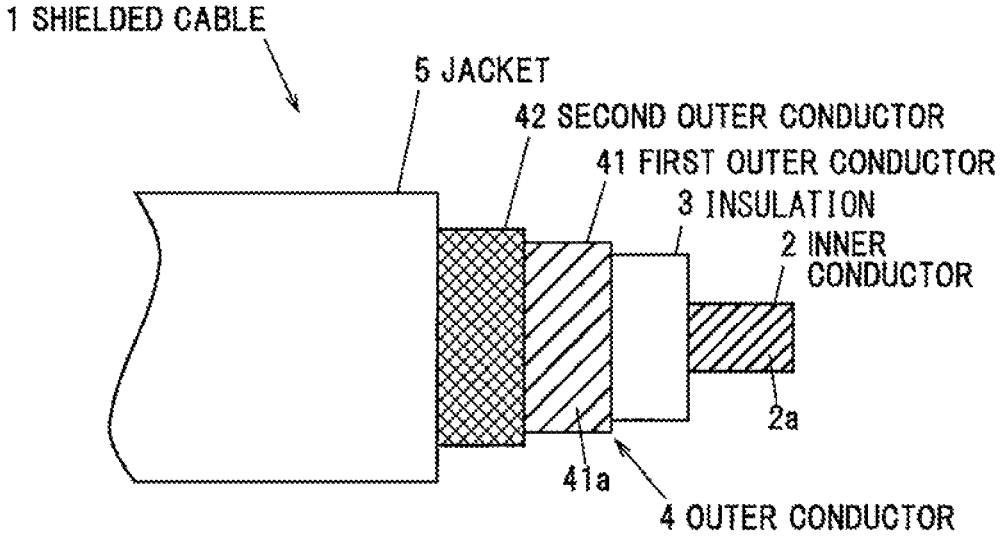
FIG. 1B is an explanation view showing a layer structure of the shielded cable in the embodiment of the invention.

FIGS. 1A, 1B are figures showing a shielded cable in the embodiment of the invention. FIG. 1A is a cross sectional view showing the cable along a cross section orthogonal to a longitudinal direction of the cable. FIG. 1B is an explanation view showing a layer structure of the cable.

As shown in FIGS. 1A, 1B, the shielded cable 1 is provided with an inner conductor 2, an insulation 3 covering an outer periphery of the inner conductor 2, an outer conductor 4 covering an outer periphery of the insulation 3, and a jacket 5 covering an outer periphery of the outer conductor 4. The shielded cable 1 is used for high-speed signal transmission at a frequency of not less than 3 GHz (e.g., 6 GHz), and especially used for transmitting, e.g., an image signal from an in-vehicle camera.

As the inner conductor 2, it is preferable to use a stranded conductor stranding inner conductor element wires 2*a* to improve flex resistance. Soft copper wires (i.e., annealed copper wires) or copper alloy wires can be used as the inner conductor element wires 2*a*. In terms of improving the flex resistance, the number of the inner conductor element wires 2*a* composing the inner conductor 2 is preferably to be seven or more. For example, the number is preferably to be nineteen. In the embodiment, the soft copper wires having outer diameters of 0.18 mm are used as the inner conductor element wires 2*a*. The inner conductor 2 having an outer diameter of approximately 0.93 mm is configured by stranding the nineteen inner conductor element wires 2*a*.

As the insulation 3, it is preferable to use an insulation having low permittivity to prevent loss at high frequency. For example, fluorine resins such as perfluoro ethylene propene copolymer (FEP) and perfluoroalkoxy alkane (PFA), and insulating resins such as polyethylene (PE), polypropylene (PP), foamed PE, and foamed PP can be used. In such case, the insulation 3 formed of foamed PE is used as the insulation 3. For example, the thickness of the insulation 3 is approximately 0.75 mm. For example, the outer diameter of the insulation 3 is approximately 2.43 mm.

As the jacket 5, it is preferable to use a jacket having heat resistance, flame resistance, and weather resistance in accordance with usage. For example, a jacket formed of a urethane can be used. For example, the thickness of the jacket 5 is approximately 0.3 mm. For example, the outer diameter of the jacket 5, i.e., the outer diameter of the entire shielded cable 1 is approximately 3.7 mm.

(Description of the Outer Conductor 4)

In the embodiment, the outer conductor 4 has a double layered structure. Specifically, the outer conductor 4 is provided with a first outer conductor 41 formed of a served shield with the first element wires 41*a* spirally wound on the outer periphery of the insulation 3, and a second outer conductor 42 formed of a braided shield braiding second element wires and installed so as to cover the outer periphery of the first outer conductor 41.

The first outer conductor 41 is configured by using the first element wires 41*a* having high conductivity, wherein the first element wires 41*a* are spirally wound on the outer periphery of the insulation 3 without gaps. Thereby, the attenuation property becomes good since this configuration is substantially the same as that having the conductor arranged sequentially in the cable longitudinal direction (e.g., the configuration where the shielding tape is longitudinally wrapped). Since the first outer conductor 41 is formed of the served shield with the first element wires 41*a* spirally wound, the flex resistance can be improved as compared to the known configuration that the shielding tape is longitudinally wrapped.

As the first element wires 41*a*, although it is preferable to use soft copper wires having high conductivity, copper alloy wires may be used where higher flexibility is demanded. It is preferable to use copper alloy wires having conductivity of not less than 90% where the copper alloy wires are used as the first element wires 41*a*. As the first element wires 41*a*, it is preferable to use the copper alloy wires that are not plated on a surface or plated with silver that has high conductivity on the surface. For example, as tin-plated copper alloy wires having low conductivity are used as the first element wires 41*a*, the attenuation property at high frequency may degrade due to the skin effect.

Although the first outer conductor 41 formed of the served shield has good attenuation property, the first outer conductor 41 may not obtain enough shielding effect against noise from outside since the first outer conductor 41 is small in volume as compared to a common braided shield. Thus, in the embodiment, the second outer conductor 42 formed of the braided shield that can improve the shielding effect against noise from outside is provided on the outer periphery of the first outer conductor 41.

The second outer conductor 42 is formed by braiding the second element wires on the outer periphery of the first outer conductor 41. The first outer conductor 41 and the second outer conductor 42 are in contact with each other. As the second element wires used for the second outer conductor 42, soft copper wires or copper alloy wires can be used. It is preferable to use the soft copper wires or the copper alloy wires of which surface is tin-plated. Also, as the second element wires, a tinsel wire with copper foil spirally wrapped on center yarn can be used.

As the second element wires used for the second outer conductor 42, it is preferable to use second element wires of which surface is coated by a lubricant oil so as to prevent scraping the first outer conductor 41 and the second outer conductor 42, and wearing in bending the shielded cable 1. For example, liquid paraffin can be used as the lubricant oil.

Meanwhile, if the lubricant oil is coated on the first element wires 41*a* of the first outer conductor 41, the attenuation property at high frequency may degrade caused by the lubricant oil. Thus, it is preferable to use the first element wires 41*a* with no lubricant oil coated and the second element wires with the lubricant oil coated thereon. As a result, wearing the first and second outer conductors 41, 42 in bending the shielded cable 1 can be prevented while preventing degrading the attenuation property at high frequency. Thus, the flex resistance can be further improved.

By the second conductor 42 formed of the braided shield, the first element wires 41*a* can be prevented from fragmenting by pressing the served first element wires 41*a* by the second outer conductor 42 so as not to move outside in a radial direction thereof when the jacket 5 is removed in termination. As a result, a termination work such as a work for attaching a connection terminal becomes easy and the attenuation property at a cable terminal can be prevented from degrading since the shielding structure is maintained at the cable terminal.

Furthermore, since the first outer conductor 41 is pressed inside by the second outer conductor 42 in the radial direction, the first element wires 41*a* is prevented from moving in the cable longitudinal direction and a gap is unlikely to be caused between the first element wires 41*a* even when bending the shielded cable 1. As a result, the attenuation property at high frequency can be prevented from degrading when bending the shielded cable 1.

The braided shield composing the second outer conductor 42 is configured to keep the flexibility of the shielded cable 1 and keep the noise resistance of the cable.

Effects of the Embodiments

As described above, the shielded cable 1 of the embodiment is constructed such that the outer conductor 4 is composed of the first outer conductor 41 formed of the served shield with the first element wires 41*a* spirally wound on the outer periphery of the insulation 3, and the second outer conductor 42 formed of the braided shield braiding the second element wires and installed so as to cover the outer periphery of the first outer conductor 41.

By the first outer conductor 41 formed of the served shield, the shielded cable 1 can have the good flex resistance as well as the good attenuation property. By the second outer conductor 42 formed of the braided shield, the shielded cable 1 can also have the good noise characteristic. Furthermore, by the second outer conductor 42, the first outer conductor 41 formed of the served shield can be prevented from fragmenting so as to improve the termination workability as well as preventing the attenuation property at the cable terminal from degrading.

Example 1

A stranded wire conductor stranding seven tin-plated copper alloy wires having the outer diameters of 0.93 mm is used as the inner conductor 2. Then, the insulation 3 having a thickness of 0.75 mm is formed by extruding foamed polyethylene resin and covering the outer periphery of the inner conductor 2 by an extruder. Then, the first outer conductor 41 formed of the served shield is formed by spirally at a pitch of 31 mm winding 75 silver-plated copper alloy wires having element wire diameters of 0.1 mm on the outer periphery of the insulation 3. Then, the second outer conductor 42 having the number of ends of 5, the number of spindles of 24, and density of 95% is formed by using tin-plated copper alloy wires having element wire diameters of 0.1 mm on the outer periphery of the first outer conductor 41. The jacket 5 is formed by extruding the foamed polyethylene resin having a thickness of 0.37 mm by an extruder and covers the outer periphery of the second outer conductor 42. Thus, the shielded cable 1 of Example 1 is manufactured.

Comparative Example 1

A shielded cable of Comparative Example 1 is manufactured so as to have the same structure as Example 1 except that a shielding tape composed of a polyethylene terephthalate resin layer and an aluminum metal layer is longitudinally wrapped on the outer periphery of the insulation, instead of the served shield and the braided shield of Example 1.

The shielded cables of Example 1 and Comparative example 1 are tested such that while one end of the shielded cables is fixed, the shielded cables are bent repeatedly by 90° to the right and left at a bending radius of 24 mm. As a result, the shielded cable 1 of Example 1 exhibits good attenuation property even when being bent repeatedly. By contrast, the shielded cable of Comparative Example 1 causes the shielding tape to be wrinkled and cracked by being bent repeatedly.

Summary of the Embodiments

Next, technical ideas understood from the embodiment will be described below citing the reference numerals, etc., used for the embodiment. However, each reference numeral, etc., described below is not intended to limit the constituent elements in the claims to the members, etc., specifically described in the embodiment.

[1] A shielded cable (1), comprising:

an inner conductor (2);

an insulation (3) covering an outer periphery of the inner conductor (2); and an outer conductor (4) covering an outer periphery of the insulation (3), wherein the outer conductor (4) comprises a first outer conductor (41) covering the outer periphery of the insulation (3) and comprising a served shield with first element wires (41*a*) spirally wound, and a second outer conductor (42) covering an outer periphery of the first outer conductor (41) and comprising a braided shield with second element wires braided.

[2] The shielded cable (1) according to [1], wherein the first outer conductor (41) comprises the first element wires (41*a*) spirally wound on the outer periphery of the insulation (3) without gaps.

[3] The shielded cable (1) according to [1] or [2], wherein the first element wires (41*a*) comprise a soft copper wire or a copper alloy wire of which surface is not plated or silver-plated.

[4] The shielded cable (1) according to any one of [1] to [3], wherein the second element wires comprise a soft copper wire or a copper alloy wire of which surface is tin-plated.

[5] The shielded cable (1) according to any one of [1] to [4], wherein the first element wires (41*a*) are not coated by any lubricant oils, and wherein the second element wires are coated by a lubricant oil.

Although the embodiments of the invention have been described, the invention according to claims is not to be limited to the above-mentioned embodiment. It should be noted that all combinations of the features described in the embodiments are not necessary to solve the problem of the invention.

Further, the invention can be appropriately modified and implemented without departing from the gist thereof.

What is claimed is:

1. A shielded cable, comprising, an inner conductor;

an insulation comprising an extrusion coating covering an outer periphery of the inner conductor, the extrusion coating comprising a material selected from the group consisting of perfluoro ethylene propene copolymer (FEP), perfluoroalkoxy alkane (PFA), polyethylene (PE), polypropylene (PP), foamed PE, and foamed PP; and an outer conductor covering an outer periphery of the insulation, wherein the outer conductor comprises:

a first outer conductor covering directly the outer periphery of the insulation and comprising a served shield with first element wires spirally wound; and a second outer conductor covering an outer periphery of the first outer conductor and comprising a braided shield with second element wires braided, and the first outer conductor is pressed inside by the second outer conductor in a radial direction, wherein the first outer conductor consists of the served shield with first element wires spirally wound directly covering the outer periphery of the insulation, wherein the first element wires are not coated by a lubricant oil, and the second element wires are coated by a lubricant oil, wherein the first element wires comprise a copper alloy wire including a surface that is silver-plated, and wherein the second element wires comprise a copper alloy wire including a surface that is tin-plated.

2. The shielded cable according to claim 1, wherein the first outer conductor comprises the first element wires spirally wound on the outer periphery of the insulation without gaps.

3. The shielded cable according to claim 1, wherein the insulation comprises one member selected from the group consisting of perfluoro ethylene propene copolymer (FEP), perfluoroalkoxy alkane (PFA), foamed PE and foamed PP.

4. The shielded cable according to claim 1, wherein the inner conductor comprises a plurality of inner conductor element wires, and a number of the first element wires is greater than a number of the inner conductor element wires.

5. The shielded cable according to claim 1, wherein the inner conductor comprises a plurality of inner conductor element wires, and a diameter of the first element wires is less than a diameter of the inner conductor element wires.

6. The shielded cable according to claim 1, wherein a diameter of the first element wires is the same as a diameter of the second element wires.

7. The shielded cable according to claim 1, wherein a number of the first element wires is greater than a number of ends of the second outer conductor.

8. The shielded cable according to claim 1, wherein a combined width of the first element wires is greater than an outer diameter of the insulation.

9. The shielded cable according to claim 1, wherein a winding pitch of the first element wires is greater than an outer diameter of the insulation.

10. The shielded cable according to claim 1, wherein the inner conductor comprises a plurality of inner conductor element wires comprising a copper alloy wire including a surface that is silver-plated.

11. The shielded cable according to claim 1, wherein the second outer conductor presses on the first outer conductor so as to prevent movement by the first element wires in a longitudinal direction of the shielded cable.

12. The shielded cable according to claim 1, further comprising:

a jacket formed on the second outer conductor; and a termination where the jacket is not formed, the second outer conductor pressing on the first outer conductor so as to prevent movement by the first element wires outwardly in a radial direction at the termination.

13. The shielded cable according to claim 1, wherein the second outer conductor presses on the first outer conductor so as to inhibit a gap from forming between the first element wires when bending the shielded cable.

14. A shielded cable, comprising, an inner conductor;

an insulating layer formed on the inner conductor and comprising one of perfluoro ethylene propene copolymer (FEP), perfluoroalkoxy alkane (PFA), polyethylene (PE), polypropylene (PP), foamed PE, and foamed PP; and an outer conductor formed on the insulating layer and comprising:

a first outer conductor formed directly on the insulating layer and comprising a served shield with spirally wound first element wires; and a second outer conductor formed on the first outer conductor and comprising a braided shield with braided second element wires, the first outer conductor being pressed inside by the second outer conductor in a radial direction, wherein the first outer conductor consists of the served shield with first element wires spirally wound directly covering the outer periphery of the insulation, wherein the first element wires are not coated by a lubricant oil, and the second element wires are coated by a lubricant oil, wherein the first element wires comprise a copper alloy wire including a surface that is silver-plated, and wherein the second element wires comprise a copper alloy wire including a surface that is tin-plated.

15. The shielded cable according to claim 14, wherein the inner conductor comprises a plurality of inner conductor element wires.

16. The shielded cable according to claim 15, wherein a number of the inner conductor element wires is seven or more.

17. The shielded cable according to claim 15, wherein the plurality of inner conductor element wires comprises one of soft copper wires and copper alloy wires.

18. The shielded cable according to claim 14, further comprising:

a jacket formed on the second outer conductor.

19. The shielded cable according to claim 18, wherein the jacket comprises one of urethane and foamed polyethylene resin.

20. The shielded cable according to claim 14, wherein the first element wires comprise one of soft copper wires and copper alloy wires having conductivity of not less than 90%.

21. The shielded cable according to claim 14, wherein an outer diameter of the inner conductor is greater than a thickness of the insulating layer.

22. The shielded cable according to claim 14, wherein an outer diameter of the inner conductor is greater than a combined thickness of the first and second outer conductors.

23. A shielded cable, comprising, an inner conductor comprising a plurality of inner conductor element wires comprising a copper alloy wire including a surface that is silver-plated;

an insulation comprising an extrusion coating covering an outer periphery of the inner conductor, the extrusion coating comprising a material selected from the group consisting of perfluoro ethylene propene copolymer (FEP), perfluoroalkoxy alkane (PFA), polyethylene (PE), polypropylene (PP), foamed PE, and foamed PP; and an outer conductor covering an outer periphery of the insulation, the outer conductor comprising:

a first outer conductor as a served shield, the first outer conductor comprising spirally-wound first element wires directly covering the outer periphery of the insulation, the first element wires comprising a copper alloy wire including a surface that is silver-plated, and the first element wires being not coated with a lubricant oil; and a second outer conductor as a braided shield, the second outer conductor comprising braided second element wires covering an outer periphery of the first outer conductor and pressing the first outer conductor in a radial direction so as to prevent movement by the first element wires in a longitudinal direction of the shielded cable, the second element wires comprising a copper alloy wire including a surface that is tin-plated, and the second element wires being coated with a lubricant oil.

* * * * *